US007540177B1

(12) United States Patent
Luo

(10) Patent No.: US 7,540,177 B1
(45) Date of Patent: Jun. 2, 2009

(54) FINGERPRINT LOCK WITH ANIMAL AND PLANT PATTERNS

(76) Inventor: Xianhao Luo, No. 10 Yile Blvd., Jiayi Road #401, Haizhu District, Guangzhou, Guangdong (CN)

( * ) Notice: Subject to any disclaimer, the term of this patent is extended or adjusted under 35 U.S.C. 154(b) by 0 days.

(21) Appl. No.: 12/017,684

(22) Filed: Jan. 22, 2008

(30) Foreign Application Priority Data

Dec. 7, 2007 (CN) ..... 2007 2 0061145

(51) Int. Cl.
*E05B 47/00* (2006.01)

(52) U.S. Cl. ..... 70/278.1; 70/423; 70/455; 340/5.53; 340/5.83; D8/330

(58) Field of Classification Search ..... 70/278.1, 70/423, 424, 455; 340/5.7, 5.53, 5.83; D8/330
See application file for complete search history.

(56) References Cited

U.S. PATENT DOCUMENTS

| | | | | | |
|---|---|---|---|---|---|
| 159,382 | A * | 2/1875 | Blake | 70/455 |
| 316,574 | A * | 4/1885 | Roland | 70/348 |
| 341,388 | A * | 5/1886 | Pior | 70/425 |
| 627,463 | A * | 6/1899 | Reinhard | 70/423 |
| 1,391,986 | A * | 9/1921 | Smith | 434/402 |
| 1,439,552 | A * | 12/1922 | Johnson | 70/428 |
| 3,258,858 | A * | 7/1966 | Cariffe, Jr. | 36/1 |
| 3,462,857 | A * | 8/1969 | Barlow et al. | 434/402 |
| 3,635,057 | A * | 1/1972 | Foote et al. | 70/424 |
| 3,898,824 | A * | 8/1975 | Borlinghaus | 70/455 |
| 3,930,391 | A * | 1/1976 | Borlinghaus | 70/455 |
| 4,192,161 | A * | 3/1980 | Borlinghaus | 70/455 |
| 4,354,367 | A * | 10/1982 | Wahl | 70/333 A |
| 4,881,391 | A * | 11/1989 | Villa et al. | 70/455 |
| 5,522,243 | A * | 6/1996 | Kusmiss | 70/330 |
| 5,718,137 | A * | 2/1998 | Huston | 70/423 |
| 5,746,078 | A * | 5/1998 | Kiernan | 70/424 |
| 6,178,787 | B1 * | 1/2001 | Titterton | 70/33 |
| 6,240,755 | B1 * | 6/2001 | Da Silva | 70/423 |
| 6,272,890 | B1 * | 8/2001 | Huston | 70/423 |
| 6,374,652 | B1 * | 4/2002 | Hwang | 70/277 |
| 6,865,913 | B2 * | 3/2005 | Yamagishi | 70/224 |
| 7,377,144 | B1 * | 5/2008 | Huang | 70/277 |
| 2006/0186987 | A1 * | 8/2006 | Wilkins | 340/5.53 |
| 2007/0193320 | A1 * | 8/2007 | Niskanen et al. | 70/423 |

* cited by examiner

*Primary Examiner*—Lloyd A Gall
(74) *Attorney, Agent, or Firm*—Global IP Services; Tianhua Gu

(57) ABSTRACT

This invention publicizes a kind of fingerprint locks with patterns of propagation, comprising of lock body, characterized by a raised fingerprint groove for lock opening, a slide lid provided on the lock body with slide connection to the body, and surrounding the fingerprint groove. There is an animal and plant pattern on surface of the slide lid and another appropriate animal and plant pattern below the lock body, which is of pattern consistent with that on the slide lid and both together forms a 3D propagation pattern. Because of the above-mentioned structure, the lock is of a beautiful appearance and strong effect of decoration.

5 Claims, 2 Drawing Sheets

FINGERPRINT LOCK WITH ANIMAL AND PLANT PATTERNS

CROSS REFERENCE TO RELATED PATENT APPLICATION

This application claims the priority of the Chinese patent application No. 200720061145.8 with filing date of Dec. 7, 2007.

FIELD OF THE INVENTION

This invention relates a kind of locks, particularly, to a kind of fingerprint locks.

BACKGROUND OF THE INVENTION

At present, there are various kinds of locks available in market. They are of plenty of styles, but common locks are usually simple in shape and without aesthetic feeling on them.

SUMMARY OF THE INVENTION

This invention is to provide a kind of fingerprint locks with patterns of propagation in beautiful appearance and good property of decoration.

To realize this aim, this utility model adopts following technical design:

A kind of fingerprint locks wit patterns of propagation, comprising of lock body, characterized by a raised fingerprint groove for lock opening, a slide lid provided on the said lock body with slide connection to the lock body, and surrounding the said fingerprint groove. There is an animal and plant pattern on surface of the said slide lid and another appropriate animal and plant pattern below the said lock body, which is of pattern consistent with that on the said slide lid and both together forms a3D propagation pattern. Because of the above-mentioned structure, the lock is of a beautiful appearance and strong effect of decoration.

The said fingerprint groove is tilted inside the said lock body.

A magnetic lock cover is provided on the said lock body.

This invention has a raised fingerprint groove in the lock body for lock opening; a slide lid is provided on the lock body and surrounds the fingerprint groove. There is an animal and plant pattern on surface of the said slide lid and another appropriate animal and plant pattern below the said lock body, which is of pattern consistent with that on the said slide lid and both together forms a 3D propagation pattern. Because of the above-mentioned structure, this invention is of a beautiful appearance and strong effect of decoration.

BRIEF DESCRIPTION OF THE DRAWINGS

A further detailed description, combined with drawings and embodiments, is made below for this Utility Model.

Where: Lock Body 1, Animal and plant Pattern 11, Lock Cover 12, Fingerprint Groove 2, Slide Lid 3, Slide Ball 4, Spring 5, inner-hexagon socket screw 6.

DETAIL DESCRIPTION OF THE INVENTION

Figure 1:
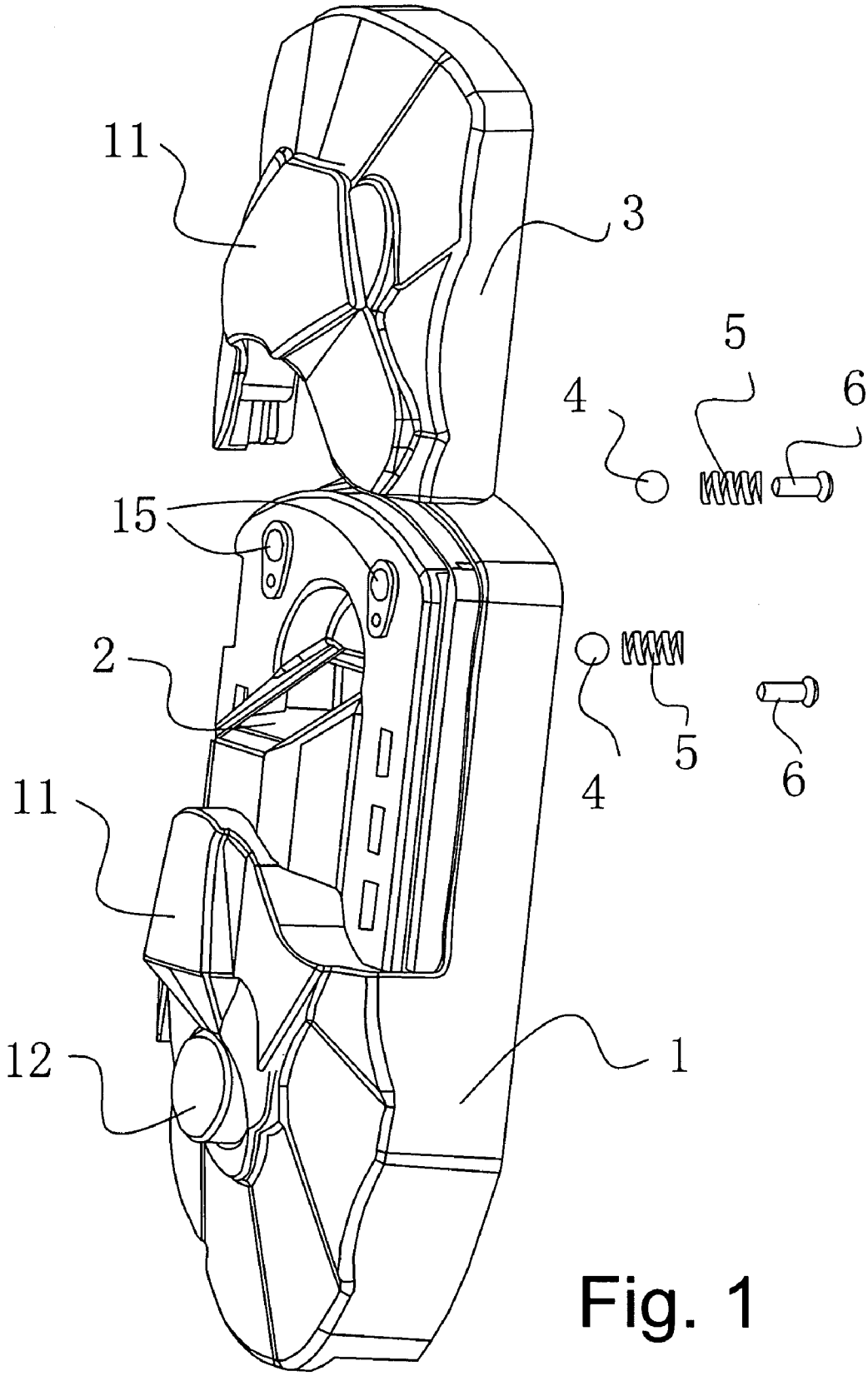
FIG. 1 is a structural diagram of parts and components of a fingerprint lock with patterns of propagation in this invention.
Figure 2:
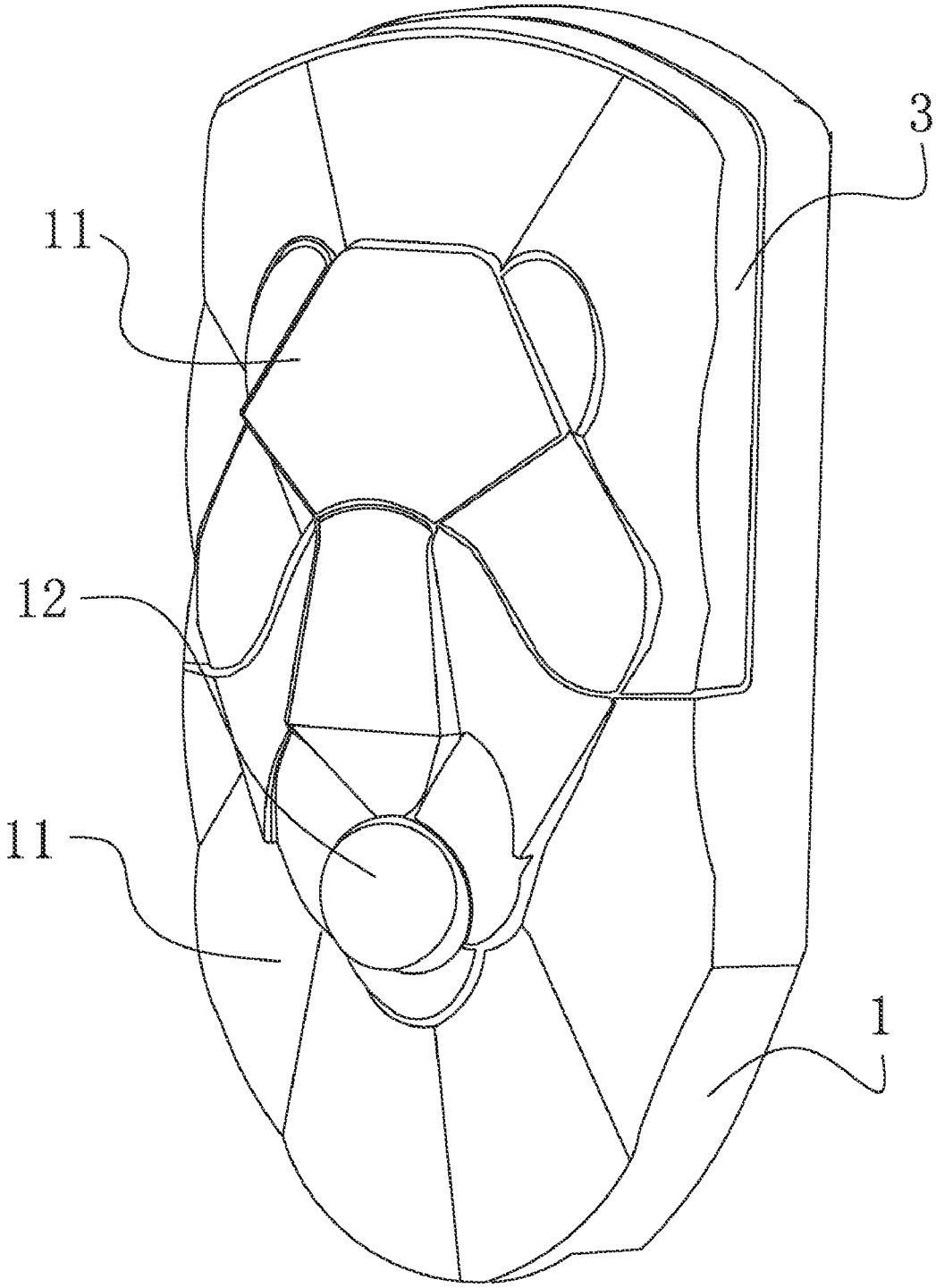
FIG. 2 is a structural diagram of a fingerprint lock with patterns of propagation in this invention.

As shown in FIG. 1, which is structural diagram of parts and components of a fingerprint lock with patterns of propagation in this invention, a kind of fingerprint locks with patterns of propagation comprises of lock body 1, and a magnetic lock cover 12 is provided on the said lock body 1. In technical design of this Invention, a slide lid 3 in slide connection with the lock body 1 is provided on the lock body and surrounds the said fingerprint groove 2, and has an animal and plant pattern 11 on surface of the said slide lid 3 and another appropriate animal and plant pattern 11 is provided below the said lock body 1, which is of pattern consistent with that on the said slide lid 3 and forms a 3D propagation pattern, for example, a pattern of a lion as shown in FIG. 2.

On operating of this Invention, User pulls out the slide lid 3 and can see the fingerprint groove 2. When user puts his finger into the fingerprint groove 2, if the fingerprint signal from the fingerprint sensor in lock body 1 matches the preset fingerprint signal, the fingerprint lock of this Invention will be opened. Besides, users also can lift the lock cover 12, insert key into lock hole and open the lock.

On all accounts, despite above description of embodiment, it is necessary to explain that, obviously, any technical person in this technical field may make variants and modifications. Therefore, these variants and modifications should be covered under protection scope of this Invention unless they are beyond the scope of this invention.

Two localizers 15 are located at the up end of the lock body 1. The localizer includes a ball. A spring 5 pushes the ball 4 forward, and a screw 6 fixes the ball 4 and the spring 5 in the lock body 1. A part of the ball 4 projects out the surface of the lock body 1. When the slide lid 3 is closed, the ball 4 is against the slide lid 3 for its location.

What is claimed is:

1. A Fingerprint Lock with animal and plant patterns comprising a Lock Body; a projecting Fingerprint Groove from the lock body for lock opening; a Slide Lid provided on said lock body, with slide connection to said Lock Body, and enwrapping said Fingerprint Groove; a part of an Animal and plant Pattern on the surface of said Slide Lid and another copulate part of Animal and plant Pattern on the surface of said Lock Body, when said slide lid is closed both parts form a 3D animal and plant pattern.

2. The Fingerprint Lock of claim 1, wherein the said Fingerprint Groove is a flume inside the said Lock Body.

3. The Fingerprint Lock of claim 1, wherein a magnetic lock cover is provided on said lock body for covering a lock hole.

4. The Fingerprint Lock of claim 2, wherein a magnetic lock cover is provided on said lock body for covering a lock hole.

5. The Fingerprint Lock of claim 1, wherein a localizer is located at the up end of the lock body, the localizer comprises a ball, a spring and a screw.

* * * * *